United States Patent [19]

Kashio

[11] 4,078,375

[45] Mar. 14, 1978

[54] ELECTRONIC TIMEPIECE

[75] Inventor: Toshio Kashio, Tokyo, Japan

[73] Assignee: Casio Computer Co., Ltd., Tokyo, Japan

[21] Appl. No.: 752,112

[22] Filed: Dec. 20, 1976

[30] Foreign Application Priority Data

Dec. 26, 1975 Japan ..... 50-158643

[51] Int. Cl.[2] ..... G04C 3/00; G04B 19/24

[52] U.S. Cl. ..... 58/23 R; 58/4 A; 58/39.5; 58/58; 235/92 T; 324/186

[58] Field of Search ..... 58/4 A, 23 R, 39.5, 58/58, 50 R; 235/169, 170; 328/48, 110; 324/186

[56] References Cited

U.S. PATENT DOCUMENTS 3,798,428 3/1974 Izawa ..... 58/23 R X

*Primary Examiner*—Edith S. Jackmon

*Attorney, Agent, or Firm*—Flynn & Frishauf

[57] ABSTRACT

An electronic timepiece includes a first memory adapted to time count data in address positions in such an order that a larger time unit is positioned ahead of a smaller time count unit, and a second memory adapted to have address positions designated in a manner to correspond to the address position of the first memory and store carry requirement numerical data, each corresponding to a final time count value of the respective time count unit of the first memory, on the basis of which a carry is effected to a next higher order position of the first memory. The first and second memories are address designated by a frequency division signal from a clock signal generator. The time count data in the address position of the first memory is compared at a comparator with the carry requirement numerical data in the corresponding address position of the second memory. When a coincidence signal emerges from the comparator the compared time count data of the address position of the first memory is cleared and "+1" is added to the next higher order address position of the first memory. When no coincidence signal appears from the comparator, counting is repeated at that address position of the first memory. The time count data is also displayed at an indicator.

6 Claims, 3 Drawing Figures

ELECTRONIC TIMEPIECE

BACKGROUND OF THE INVENTION

This invention relates to an electronic timepiece including an improved time count means for counting reference clock signals of a reference oscillator for each display time unit.

In an electronic timepiece for effecting time display by an electronic type digital display means, an electronic time count means is used to supply electronic time display signals to a display section and a reference oscillator for generating reference clock signals are used to effect time counting by the electronic time count means. That is, the reference oscillator generates a reference clock signal of, for example, $2^{15}$ Hz. The reference clock signal is frequently divided to provide, for example, a one pulse per second (1P/1S) signal. The 1P/1S signal is formed by passing the reference clock signal through a multi-stage frequency divider. Such a 1P/1S second signal is supplied to a decimal counter where carry pulse signals are obtained for every 10 seconds. The 1P/1S (one pulse per 10 seconds) signals are counted at a scale-of-6 second counting circuit from which a time display signal is generated for every 10 seconds. The scale-of-6 second counting circuit generates a carry signal (1P/1M) for each 60 seconds, i.e., each minute. The 1P/1M signal is counted at a minute counting circuit comprising series-connected scale-of-10 and scale-of-6 counters. The 'minute' counting circuit generates a time indicating signal corresponding to a minute time unit. The carry signal of the 'minute' counting circuit is counted at a scale-of-12 counter to provide a time indicating signal corresponding to a hour time unit.

That is, for each time unit a corresponding scale counter such as a scale-of-6 counter, scale-of-10 counter etc. is provided having a corresponding carry requirement. Each counter is serially connected so that it effects a counting operation by carry signals. Thus providing a time count circuit.

Since such a time count circuit is subjected to digital control, it is formed of series-connected LSI binary counters. The time count circuit is divided into sections according to each time unit and a carry requirement is set for each section according to the time unit. That is, a multi-stage frequency divider is necessary for the reference clock signal of a reference oscillator to be converted to a 1P/1S signal on the basis of which a second coutning is effected. Furthermore, it is also necessary to divide the time count circuit into sections corresponding to time units on the basis of which respective carry requirements are set, requiring a multi-stage arrangement and in consequence resulting in a complicated arrangement. This provides a far to the simplification of the time count circuit. Since the dissipation power of the frequency divider is increased in proporiton to the frequency, the multi-stage arrangement requires a corresponding greater dissipation power. Since a wrist watch etc. are subjected to a restriction on the capacity of a cell, it is necessary to reduce a dissipation power.

It is accordingly the object of this invention to provide a novel electronic timepiece which can make a frequency-division stage sufficiently small and can reduce a dissipation power through the effective use of semiconductor memories without using any conventional time count circuit as a time count means.

SUMMARY OF THE INVENTION

According to this invention there is provided an electronic timepiece comprising an oscillator circuit for producing a reference clock signal; a first memory adapted to be controlled by the clock pulse and sequentially store time count data in address positions in such an order that a larger time count unit is positioned ahead of a smaller time count unit; a second memory adapted to be address-designated in a manner to correspond to the address position of the first memory and store carry requirement numerical data, each corresponding to a final time count value of the respective time count unit of the first memory, on the basis of which a carry is effected to the next higher order position; address designating means for sequentially supplying address designation signals to the address positions of the first memory while the corresponding address positions of the first and second memories are set in synchronism with each other; a comparison means for comparing between the time count data in the address position of the first memory and the carry requirement numerical data in the corresponding position of the second memory according to the address designation of the address designating means; carry generating means for generating a carry signal to an address position next higher in order than the address position in the first memory the time count unit of which is compared at the comparing means; adding means for adding "1" to a time count data in said next higher order address position of the first memory in response to the carry signal of said carry generating means; and display means for displaying time data corresponding to the time count data of the respective time count units of the first memory.

According to this invention it is not necessary to provide a multi-stage frequency divider in which specific carry requirements are set to corresponding time units. That is, semiconductor memories such as RAM, ROM etc are used to provide time counting, and the time counting of the semiconductor memories is readily controlled by a simple control means. A great merit is provided if these means are used in a solid-state wrist watch etc. Not only the time counting function, but also the other function can be incorporated in this invention.

A time error resulting from a long lapse of time can be corrected by variably setting a carry requirement numerical data in the second memory which corresponds to a time unit smaller than a "second." For this reason, it is not necessary that a trimmer capacitor of an oscillator be rotated for correction in an attempt to adjust the oscillation frequency of the oscillator. It is therefore possible to provide an electronic timepiece which can attain a high accuracy only through all-electronic time counting control.

BRIEF DESCRIPTION OF THE DRAWINGS

This invention can be more fully understood from the following detailed description when taken in conjunction with the accompanying drawings, in which.

DETAILED DESCRIPTION

One embodiment of this invention will now be described by referring to the accompanying drawings.

Figure 1:
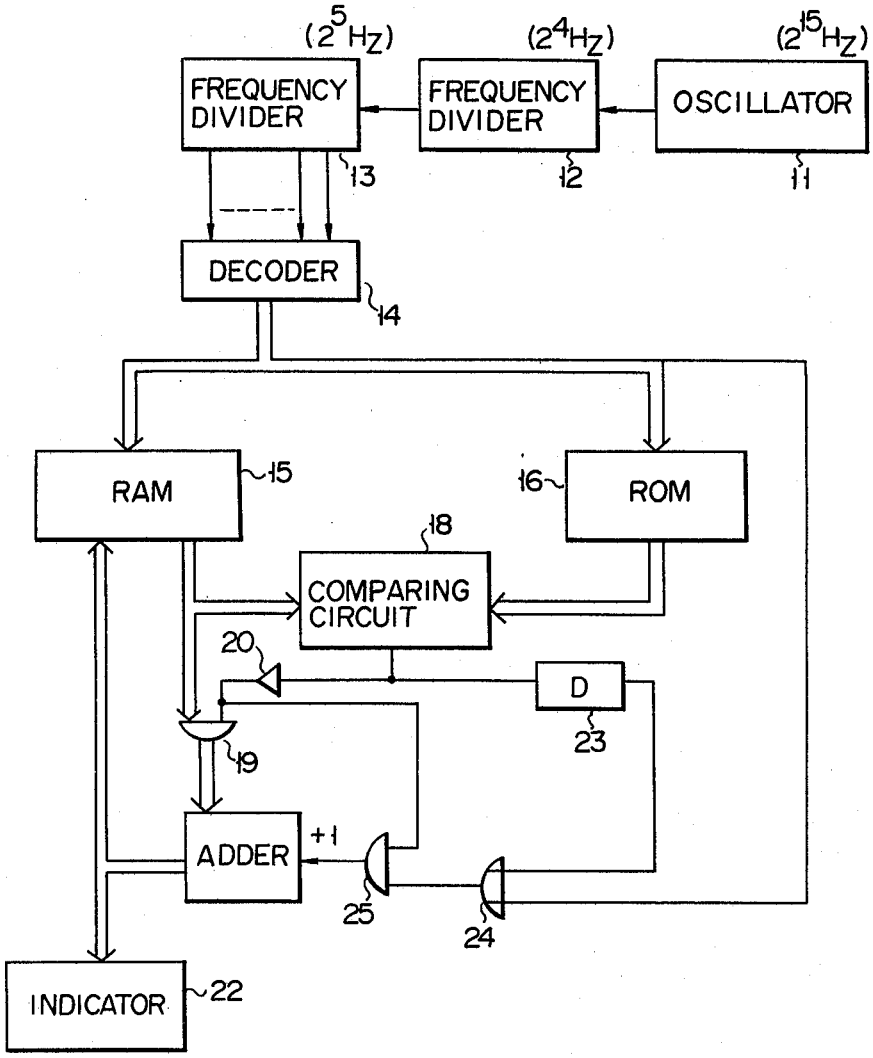
FIG. 1 is a block diagram schematically showing an electronic timepiece according to one embodiment of this invention.

FIG. 1 shows a block diagram according to one embodiment of this invention. A reference oscillator 11 constructed of, for example, a crystal oscillator etc. generates a reference clock oscillation signal of, for example, $2^{15}$ Hz. The clock signal of the reference oscillator 11 is serially supplied to, for example, $2^4$ Hz and $2^5$ Hz frequency division circuits in this order, and the $2^5$ Hz frequency division circuit generates a 5-bit counting signal in a $2^6$ Hz cycle. The 5-bit counting signal of the frequency division circuit 13 is fed to a decoder 14. The decoder 14 delivers an address designating signal corresponding to the counting signal of the $2^5$ Hz frequency division circuit to first and second memories 15 and 16. The first memory 15 is constructed of RAM (RANDOM ACCESS MEMORY) and the second memory 16 is of ROM (READ ONLY MEMORY). The first memory 15 designates a predetermined time unit to an address designated by the address designating signal of the decoder 14 and the second memory 16 stores designated count values, carry generating requirements of the counting unit now under consideration, in an address corresponding to the address position of the first memory 15.

Figure 2:
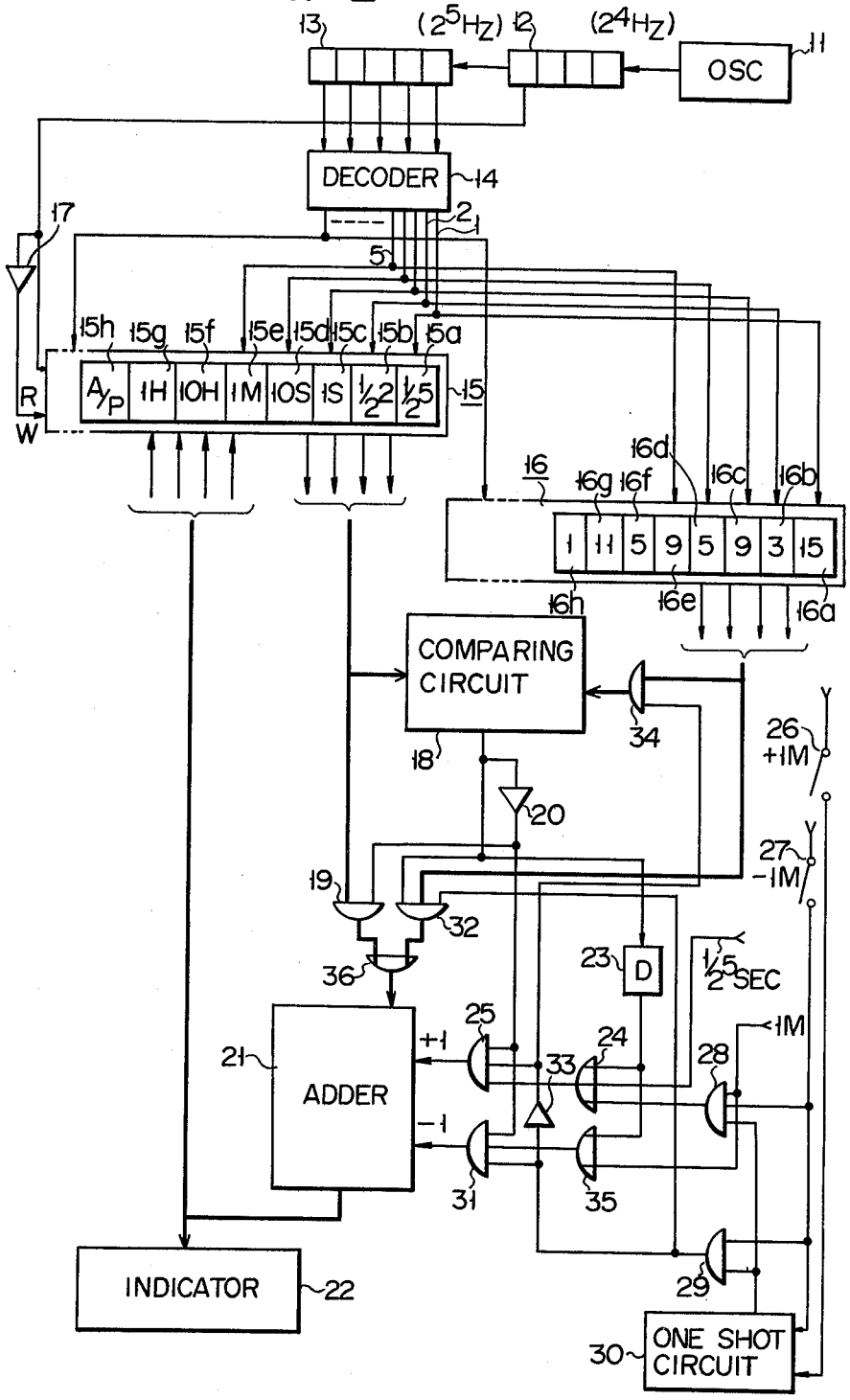
FIG. 2 is a detailed circuit arrangement of the electronic timepiece in FIG. 1.

The detail arrangement of the first and second memories in FIG. 1 is shown in FIG. 2. Addresses or storage digits 15*a*, 15*b*, . . . are provided in the first memory 15 in a manner to correspond to the address numbers 1, 2, . . . respectively. The storage digit 15*a* of the first memory 15 stores the time unit of a $1/2^6$ second corresponding to one cycle of the address designating counting signal, and the storage digits 15*b*, 15*c*, 15*d*, 15*e*, 15*f*, 15*g* and 15*h* correspond to the time units of a $1/2^6$ second, 1 second, 10 second, 1 minute, 10 minute, 1 hour, AM and PH, respectively. Like the first memory 15, the second memory 16 stores the carry generating requirements corresponding to the storage digits 15*a*, 15*b*, . . . , respectively, in the first memory 15. In the first memory 15, for example, the storage digit 15*a* stores the time required for a carry to be effected from the $1/2^5$ digit position to the $1/2^2$ digit position and the storage digit 15*b* stores the time required for a carry to be effected from the $1/2^2$ second position to the 1 second digit position. Since the storage digit 16*a* of the second memory 16 stores the time corresponding to 15 counts as a carry requirement, a carry "1" is effected for every 16 counts from the storage digit 15*a* to the storage digit 15*b* of the first memory 15. Likewise, the storage digits 16*b*, 16*c*, 16*d*, 16*e*, 16*f*, 16*g* and 16*h* of the second memory 16 store "3," "9," "5," "9," "5," "11" and "1" as count designating values, respectively.

In the first memory 15, the storage digits 15*a*, 15*b*, . . . corresponding to addresses designated by the decoder 14 are read (R)/write(W) controlled by signals obtained from the output digit section of the frequency division circuit 12 upon each address designation, and in the second memory 16 the address-designated storage digits 16*a*, 16*b*, . . . are read out. When a data on the output digit section of the frequency division circuit 12 is "1," a read (R) instruction is given to the first memory and when a data on the output section of the frequency division circuit 12 is "0," (W) write instruction is given by the output of the inverter 17 to the first memory. At this time, a read instruction is being applied to the second memory.

Data read out from the first and second memories 15 and 16, which correspond to the address designation of the decoder 14, are coupled to a comparing circuit 18 for comparison. The data from the first memory 15 is connected to one gate of an AND circuit 19. A coincidence output signal from the comparing circuit 18 is, after inverted at an inverter 20, connected to the other gate of the AND circuit 19. When no coincidence output signal emerges from the comparing circuit 18, the data from the first memory 15 is coupled directly to the AND gate 19. The output of the AND gate 19 is coupled through an OR gate 36 to an adder 21. As a result of addition the output of the adder 21 is fed back to the first memory 15 and stored in the storage digit earlier read out. At the same time, the output of the adder 21 is supplied to, for example, a digital type indicator 22 for time display.

The coincidence detection signal of the comparing circuit 13 is delivered to a delay circuit 23 and the delay time of the dealy circuit 23 is set to correspond to the unit address shift time of the decoder 14. When the count value of the storage digit following the storage digit from which the coincidence detection signal is obtained is read out, the delay circuit 23 generates an output signal, which is supplied through an OR circuit 24 to an AND circuit 25. The gate of the AND circuit 25 is opened by the output signal of the inverter 20. The output of the AND circuit 25 is supplied as a "+1" instruction to the adder 21. A signal corresponding to the address designation by the decoder 14 to the lowest order digit of the first and second memories 15 and 16 is connected to the OR circuit 24.

FIG. 2 shows the fundamental arrangement and a time correction means added to the fundamental arrangement. A switch 26 for supplying a "+1 minute (+1M)" time correction instruction signal is provided together with a switch 27 for supplying a "−1 minute (−1M)" time correction signal. During the thrown in of the switches 26 and 27 a gate signal is applied to AND circuits 28 and 29. To the gates of the AND circuits 28 and 29 is also supplied an output signal of a one shot circuit 30. The one shot circuit 30 is adapted to generate a one shot pulse during the thrown in of the switches 26 and 27. The output of the delay circuit 23, as well as an address designation signal corresponding to the time unit of 1M, is coupled to an OR circuit 35, the output of which is coupled to an AND circuit 31. The coincidence detection output signal of the comparing circuit 18 is applied as a gate signal to an AND circuit 32. The outputs of the AND circuit 32 and AND circuit 19 are connected to the OR circuit 36 and the output of the OR circuit 36 is connected to the adder 21.

A reference clock signal of $2^{15}$ Hz is supplied to the frequency division circuit 12 and then to the frequency division circuit 13 for frequency division. The decoddr 14 generates an address designation output with respect to the first and second memories 15 and 16 in a manner to correspond to a 5-bit count signal obtained from the frequency division circuit 13. An output generation time interval for effecting the address designation by the decoder 14 is set by, for example, a cycle of $1/2^6$ (1/64). The values of the lowest order digits 15*a* and 16*a* of the first and second memories 15 and 16, respectively, is read out when an output "1" for address designation is generated from the decoder 14. At this time, no time correction is effected and when the switch 27 is in the open state an inverter 33 produce an output which opens the gate of an AND circuit 34. In consequence, numerical data read out from the storage digits 15*a* and 16*a* of the first and second memories 15 and 16 are compared at the comparing circuit 18. When these numerical data do not coincide with each other, the gate of the AND circuit 19 is opened by the output of the inverter 20 and the numerical data read out of the storage digit 15*a* of the first memory 15 is applied through the AND circuit 19 and OR circuit 36 to the adder 21. Since at this time gate signals are applied one through the inverter 20 and one through the inverter 33 to the AND circuit 25, when a $1/2^5$ sec output is generated from the storage digit 15*a* of the first memory 15, the output of the storage digti 15*a* of the first memory is coupled as a gate signal to the AND circuit 25 and the output of the AND circuit 25 is supplied as a "+1" instruction to the adder 21 where +1 is added to the numerical data delivered from the storage digit 15*a* of the first memory 15 through the OR circuit 19. The output of the adder 21 is fed back to the first memory 15 and stored as a "+1" data in the storage digit 15*a* of the first memory 15. That is, "1" is added to the numerical value of the first digit 15*a* of the first memory 15 each time the address designation is effected by the decoder 14 and the time count is made in time units of $1/2^6$(1/64) seconds.

When the storage digits 15*b* and 16*b*, 15*c* and 16*c*, . . . of the first and second memories 15 and 16 are sequentially address-designated by the decoder 14, no $1/2^6$ second cycle signal is coupled to the AND circuit 25 in synchronism with these storage data. When numerical data read out from the first and second memories 15 and 16 are compared at the comparing circuit 18 and no coincidence output is generated from the comparing circuit 18, the numerical data is fed back to the storage digits 15*b*, 15*c*, . . . of the first memory through the adder 21. That is, the numerical data read out from the storage digits 15*b*, 15*c* . . . of the first memory are written into the storage digits 15*b*, 15*c* . . . of the first memory for storage. The numerical data passed through the adder 21 is also coupled to the display device 22 for time display.

When numerical data read out from the most storage digits 15*a* and 16*a* of the first and second memories 15, 16 coincide with each other, a coincidence detection signal is generated from the comparing circuit 18. That is, since the gates of the AND circuits 19 and 25 are closed, input data to the adder 21 become zero and no "+1"0 instruction is present at the AND circuit 25. Since an output numerical data of the adder 21 is "0," the numerical data of the storage digit 15*a* is cleared to "0" according to the carry generating requirement "15" which is stored in the storage digit 16*a* of the second memory 16.

At the same time, the coincidence signal of the comparing circuit 18 is delayed at the delay circuit 23 and an output signal appears from the delay circuit 23 when the next storage digits 15*b* and 16*b* of the first and second memories 15 and 16 are address-designated by the decoder 14. When numerical data are read out from the storage digits 15*a* and 16*b* of the first and second memories 15 and 16 and no coincidence signal is obtained at the comparing circuit 18, the numerical data read out from the storage digit 15*b* of the first memory 15 is supplied through the AND circuit 19 and OR circuit 36 to the adder 21. At this time, the AND circuit 25 receives the output of the inverter 33, output of the delay circuit 23 and output of the inverter 20. The output of the AND circuit 25 is applied as a "+1" instruction to the adder 21 where 1 is added to the numerical data read out from the storage digit 15*b* of the first memory 15. The added numerical data of the adder 21 is written into the storage digit 15*b* of the first memory for storage.

That is, "1" is added at a cycle of 1/26 cycle to the storage digit 15*a* of the first memory 15 and, when the numerical data stored in the storage digit 15*a* of the first memory 15 reaches a numerical data of the storage digit 16*a* of the second memory 16, "1" is added to the next higher order storage digit 15*b* of the first memory 15 and at the same time the numerical data of the storage digit 15*a* of the first memory 15 is cleared to "0." In this way, a carry is effected for each storage digit for the first memory 15 according to the numerical data corresponding to the carry generating requirement which is stored in each storage digit of the second memory 16 and a time data is stored in the respective storage digits 15*a*, 15*b* . . . of the first memory 15 and the time data is displayed on the indicator 22, for example, in a digital fashion.

In this embodiment, time correction can be made in units of 1 minute. Where it is desired to gain one minute, the swtich 26 is closed. Then, the gate of the AND circuit 28 is opened, during one circulation of the address designation by the decoder 14, by the output of the one shot circuit 30 and, when a 1M data is read out from the storage digit 15*e* of the first memory 15, a "+1" instruction is given to the AND circuit 25 through the AND circuit 28 and OR circuit 24 and "1" is unconditionally added to the numerical data of the storage digit 15*e* of the first memory 15. As a result, 1 minute is gained. Where it is desired to lose one minute, the switch 27 is closed. Then, the gate of the AND circuit 29 is opened by the output of the one shot circuit 30. since the output of the AND circuit 29 is coupled to the inverter 33, the gate of the AND circuit 34 is closed and a reference numerical value to the comparing circuit 18 becomes "0." Since no coincidence output is delivered from the comparing circuit 18, the output of the inverter 20 is applied as "−1" instruction to the adder 21 through the AND circuit 31. As a result, "1" is subtracted at the adder 21 from a numerical data delivered from the storage digit 15*e* of the first memory 15 through the AND circuit 19. The result of the subtraction is stored in the storage digit 15*e* of the first memory 15 and thus a one-minute time delay is attained. When, however, a numerical value of the storage digit 15*e* of the first memory 15 is "0," the gate of the AND circuit 34 is closed and, when "0" is read out from the storage digit 15*e* of the first memory 15, a coincidence detection signal appears from the comparing circuit 18, closing the gates of the AND circuits 19 and 31 and opening the gate of the AND circuit 32. As a result, a data "9" read out from the storage digit 16*e* of the second memory 16 is supplied to the adder 21 and the data "9" is written from the adder 21 into the storage digit 15*e* of the second memory 15. In this way a one-minute time delay is obtained.

Although in the above-mentioned embodiment the specified time count data and carry requirement data are beforehand stored in the first and second memories 15 and 16, respectively, and the AM/PM is judged, storage digits corresponding to a year, a data, a day of a weak etc. can be set together with the corresponding carry requirements. Any other time count functions as found in a stopwatch, global watch, timer etc. can be provided as desired. In this case, the number of storage digits necessary to attain such functions is prepared and time count data and carry requirement data are stored in memories 15 and 16, respectively.

Figure 3:
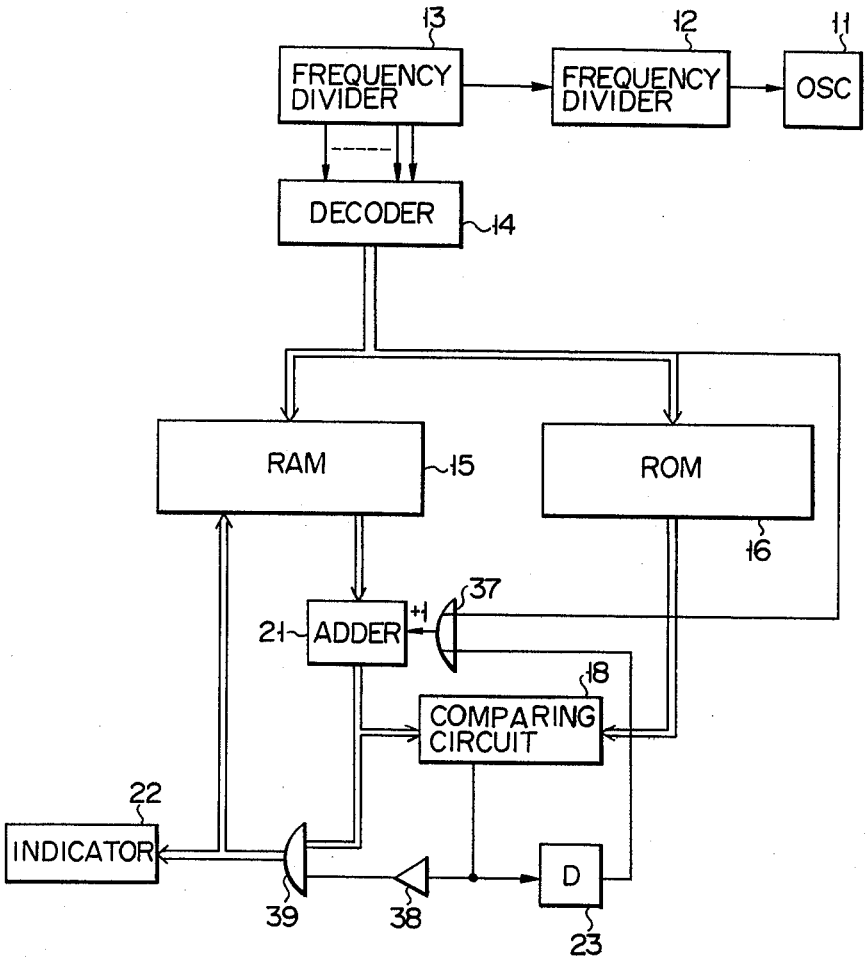
FIG. 3 is a block diagram showing an electronic timepiece according to another embodiment of this invention.

In the above-mentioned embodiment, after data read out from the first and second memories 15 and 16 are compared at the comparing circuit, a carry is effected as required. As shown in FIG. 3, however, after addition is effected at an adder 21 comparison can be effected between a data read out from a RAM 15 and a data from a ROM 16. In this case, a "+1" instruction is applied through an OR circuit 37 to the adder 21 when an address designation to the lowest order digits 15*a* and 16*a* is effected and an output signal appears from delay circuit 23 to which is coupled the output of a comparing circuit 18. When no coincidence signal appears from the comparing circuit 18 the output of the adder 21 is delivered back to the first memory 15 through an AND circuit 39 the gate of which is opened by the output of an inverter 38. When a coincidence signal emerges from the comparing circuit 18 the gate of the AND circuit 39 is closed and a numerical data "0" is stored in the corresponding storage digit of the first memory 15. In this case, however, it is necessary to add "1" to a numerical data of storage digits 16*a* to 16*h* of the second memory 16.

In the above-mentioned embodiment the $10^{15}$ Hz crystal oscillator is used as a reference oscillator and the frequency dividers 12 and 13 have the frequency division ratios of $10^4$ and $10^5$, respectively. The frequency dividers may be modified in a variety of ways. If, for example, the frequency circuits 12 and 13 have the refrequency division ratios of $10^{11}$ and $10^4$, respectively, 16 address designations (maximum) can be effected to the first memory and a minimum address can be set in units of seconds.

This invention is not restricted to one having an inherent reference oscillator and it can also be applied to a clock device etc. using 50 Hz or 60 Hz (commercial power source) as a reference oscillation frequency. This invention can be changed without departing from the spirit and scope of this invention.

What is claimed is:

1. An electronic timepiece comprising an oscillator circuit for producing a reference clock signal; a first memory adapted to be controlled by the clock pulse and sequentially store time count data in address positions in such an order than a larger time count unit is positioned ahead of a smaller time count unit; a second memory adapted to be address-designated in a manner to correspond to the address position of the first memory and store carry requirement numerical data, each corresponding to a final time count value of the respective time count unit of the first memory, on the basis of which a carry is effected to the next higher order position; address designating means for sequentially supplying address designation signals to the address positions of the first memory while the corresponding address positions of the first and second memories are set in synchronism with each other; comparison means for comparing between the time count data in the address position of the first memory and the carry requirement numerical data in the corresponding position of the second memory according to the address designation of the address designating means; carry generating means for generating a carry signal to an address position next higher in order than the address position in the first memory the time count unit of which is compared at the comparing means; adding means for adding "1" to a time count data in said next higher order address position of the first memory in response to the carry signal of said carry generating means; and display means for displaying time data corresponding to to the time count data of the respective time count units of the first memory.

2. An electronic timepiece according to claim 1, in which said first memory comprises a random access memory and said second memory comprises a read only memory.

3. An electronic timepiece according to claim 1, further including means for clearing a time count data in the address position, in the first memory when a coincidence signal is detected at said comparing means.

4. An electronic timepiece according to claim 1, further including a circuit for storing a coincidence signal from said comparing means and means for applying an output signal to said adding means.

5. An electronic timepiece according to claim 1, in which said comparing means is adapted to compare between a time count signal as obtained by adding "1" to a time count data read out of the address position of the first memory and a carry requirement numerical data in the corresponding address position of said second memory.

6. An electronic timepiece according to claim 1, comprising means for effecting a time correction which includes means for supplying a correction signal through said adding means to that specified address position of said first memory where a specific time unit is stored.

* * * * *

UNITED STATES PATENT AND TRADEMARK OFFICE

CERTIFICATE OF CORRECTION

PATENT NO. : 4,078,375

DATED : March 14, 1978

INVENTOR(S) : TOSHIO KASHIO

It is certified that error appears in the above—identified patent and that said Letters Patent is hereby corrected as shown below:

COLUMN 7 (claim 1), line 46, after "such an order" change "than" to --that--;

COLUMN 8 (claim 1), line 21, after "corresponding" change "to to" to --to--.

Signed and Sealed this

*Third* Day of *March 1981*

[SEAL]

*Attest:*

RENE D. TEGTMEYER

*Attesting Officer*

*Acting Commissioner of Patents and Trademarks*